US007908709B2

(12) United States Patent
Cruz et al.

(10) Patent No.: US 7,908,709 B2
(45) Date of Patent: Mar. 22, 2011

(54) CHECK LINK ASSEMBLY

(75) Inventors: Roberto Cruz, Mexico City (MX); Luis Miguel Del Pozo Gonzalez, Puebla (MX); Jose Carlos Murillo Marquez, Toluca (MX); Richard J. Lange, Troy, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 484 days.

(21) Appl. No.: 12/024,302

(22) Filed: Feb. 1, 2008

(65) Prior Publication Data

US 2008/0184525 A1 Aug. 7, 2008

Related U.S. Application Data

(60) Provisional application No. 60/887,690, filed on Feb. 1, 2007.

(51) Int. Cl.
*E05C 17/22* (2006.01)

(52) U.S. Cl. ..... 16/86 C; 16/86 B

(58) Field of Classification Search ..... 16/86 A, 16/86 B, 86 C, 86 R; 292/277, 262, 265, 292/DIG. 19, 273, 275, DIG. 15; 296/146.12, 146.11, 146.1
See application file for complete search history.

(56) References Cited

U.S. PATENT DOCUMENTS

| | | | | | |
|---|---|---|---|---|---|
| 2,860,369 | A | * | 11/1958 | Galla | 16/85 |
| 5,173,991 | A | * | 12/1992 | Carswell | 16/86 A |
| 5,474,344 | A | * | 12/1995 | Lee | 292/262 |
| 6,813,811 | B2 | * | 11/2004 | Matsuki et al. | 16/86 B |
| 6,901,630 | B2 | | 6/2005 | Liang et al. | |

FOREIGN PATENT DOCUMENTS

| | | | |
|---|---|---|---|
| GB | 2266338 | A | * 10/1993 |
| JP | 08260797 | A | * 10/1996 |
| JP | 10246052 | A | * 9/1998 |
| JP | 2003336424 | A | * 11/2003 |

* cited by examiner

*Primary Examiner* — Chuck Y. Mah
(74) *Attorney, Agent, or Firm* — Quinn Law Group, PLLC

(57) ABSTRACT

A check link assembly is operatively connectable to a door to provide resistance to the rotation of the door. The amount of resistance varies with the position of the door to provide at least one detent position. The check link assembly stores energy when the door is latched in its closed position, and is configured to release the energy when the door is unlatched so that the door moves toward its open position.

4 Claims, 4 Drawing Sheets

CHECK LINK ASSEMBLY

CROSS REFERENCE TO RELATED APPLICATION

This application claims the benefit of U.S. Provisional Patent Application No. 60/887,690, filed Feb. 1, 2007, which is hereby incorporated by reference in its entirety.

TECHNICAL FIELD

This invention relates to door systems having springs to selectively urge a door toward its open position.

BACKGROUND OF THE INVENTION

A typical automotive vehicle includes a vehicle body defining a passenger compartment. Doors are selectively movable between open and closed positions to permit access (ingress and egress) to the passenger compartment and obstruct access to the passenger compartment, respectively, as understood by those skilled in the art. A latch is typically employed to maintain a door in its closed position. To open a door, a vehicle user must pull on a door handle to release the latch and manually move the door to the open position.

SUMMARY OF THE INVENTION

A check link assembly is provided for a door rotatably mounted to a vehicle body. The door is selectively movable between a closed position and an open position. The check link assembly includes a link having a contoured surface, a member contacting the contoured surface, and a spring biasing the member into contact with the contoured surface. The contoured surface is configured such that, when the link is operatively connected to one of the body and the door and the member is operatively connected to the other of the body and the door, and the door is in the closed position, the spring is operative to cause the door to move toward the open position.

Accordingly, the check link assembly facilitates movement of the door from the closed position toward the open position. The check link assembly also facilitates the absence of an outside door handle operative to release a door latch, because the check link assembly is operative to move the door from its closed position upon the release of the latch.

A vehicle body is also provided. The vehicle body includes vehicle body structure and a vehicle door that is operatively connected to the vehicle body structure. The door is selectively rotatable between a closed position and an open position. A check link assembly operatively interconnects the door and the vehicle body structure, and includes a spring and a link characterized by a contoured surface operatively engaging the spring. The contoured surface is configured such that compression of the spring varies with the position of the door so that resistance to movement of the door between the closed position and the open position varies with the position of the door. The contoured surface is configured such that the spring is decompressed during movement of the door from the closed position to a partially open position.

DESCRIPTION OF THE PREFERRED EMBODIMENTS

Figure 1:
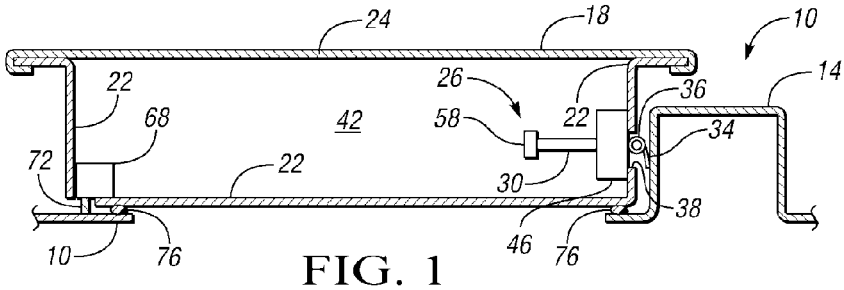
FIG. 1 is a schematic, cross sectional top view of a vehicle door in a closed position with respect to a vehicle body, and a check link assembly operatively interconnecting the door and the body.
Figure 2:
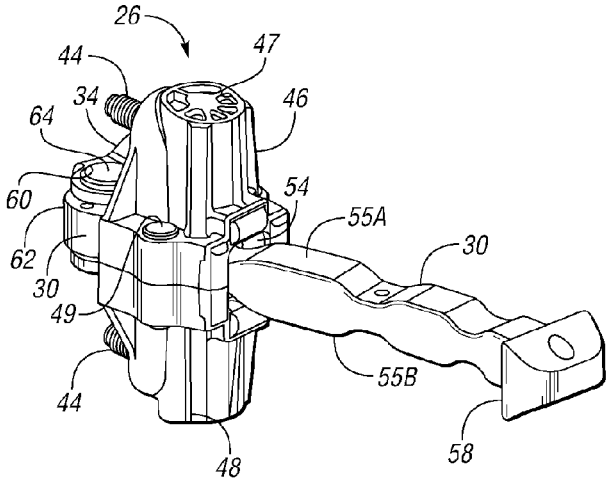
FIG. 2 is a schematic, perspective view of the check link assembly of FIG. 1.
Figure 3:
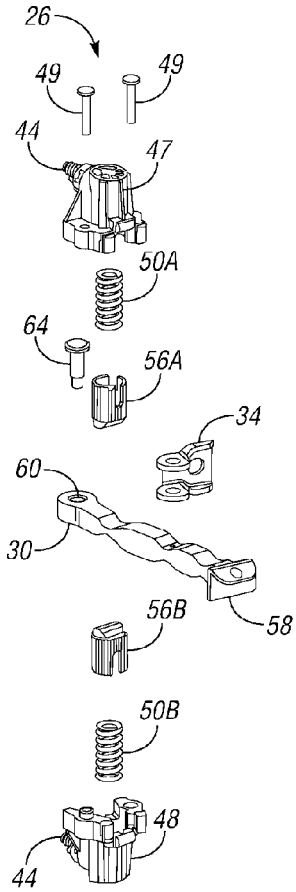
FIG. 3 is a schematic, exploded view of the check link assembly of FIG. 1, including a housing, springs, bumpers, and a check link.

Referring to FIG. 1, a vehicle body 10 includes a hinge pillar 14, as understood by those skilled in the art. A vehicle door 18 is rotatably mounted to the hinge pillar 14 via at least one hinge (not shown) as understood by those skilled in the art for rotation between a closed position (as shown in FIG. 1) and an open position. The door 18 includes an inner panel 22 and an outer panel 24 operatively connected to one another, such as by hemming. Referring to FIGS. 1-3, A check link assembly 26, also sometimes referred to as a "door check" or a "hold open," includes a check link 30. A bracket 34 is mounted to the hinge pillar 14, and is pivotably mounted to the check link 30 such that the check link 30 is selectively rotatable with respect to the hinge pillar 14 about a vertical axis 36 that is substantially parallel to the axis of rotation of the door 18. As used herein, a "hinge pillar" may include a front hinge pillar, a B-pillar, etc.

The check link 30 extends through an aperture 38 formed in the inner panel 22 and into the door cavity 42, which is defined by the inner panel 22 and the outer panel 24. The check link assembly 26 also includes a housing 46 that is disposed within the door cavity 42 and mounted to the inner panel 22. In the embodiment depicted, threaded studs 44 mounted to the housing 46 extend through holes (not shown) in the inner panel 22 and engage nuts (not shown) to retain the housing 46 against the inner panel 22. Accordingly, rotation of the door 18 with respect to the hinge pillar 14 causes relative movement between the housing 46, which is mounted to the door 18, and the check link 30, which is mounted to the hinge pillar 14.

Figure 4:
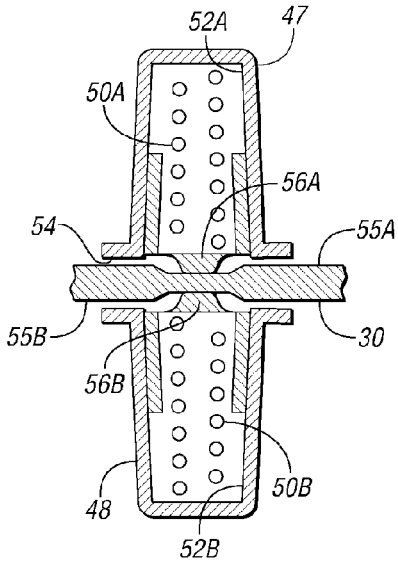
FIG. 4 is a schematic, cross-sectional view of a portion of the check link assembly of FIG. 1.

Referring to FIGS. 2-4, the housing 46 in the embodiment depicted includes two housing portions 47, 48 that are operatively connected together by fasteners 49. Each housing portion 47, 48 contains a respective spring 50A, 50B. More specifically, each housing portion 47, 48 defines a respective cavity 52A, 52B that at least partially contains a respective one of the springs 50A, 50B. The housing portions 47, 48 are connected to one another such that the housing 46 defines a passageway 54. The check link 30 extends through the passageway 54 of the housing 46, and is selectively moveable therethrough between the springs 50A, 50B. Springs 50A, 50B are depicted as metal coil springs; however, those skilled in the art will recognize a variety of spring configurations and materials that may be employed within the scope of the claimed invention. For example, the springs may be rubber pads, torsion springs, etc.

The check link 30 is characterized by contoured surfaces 55A, 55B on opposite sides of the link 30. The surfaces 55A, 55B define ramps, depressions, etc. that interact with the springs 50A, 50B to vary the resistance to movement of the door 18 during its rotation between the open and closed positions. In the embodiment depicted, the ramps, depressions, etc. interact with the springs 50A, 50B via first and second members, namely bumpers 56A, 56B. More specifically, bumper 56A is slidingly engaged with the walls of cavity 52A. Spring 50A biases the bumper 56A into contact with the portion of surface 55A that is inside the passageway 54. Bumper 56B is slidingly engaged with the walls of cavity 52B. Spring 50B biases the bumper 56B into contact with the portion of surface 55B that is inside the passageway 54. Accordingly, the thickness of the check link 30 between the bumpers 56A, 56B determines the amount of compression to which the springs 50A, 50B are subjected.

A stop 58 is mounted at one end of the check link 30 to restrict excessive movement of the check link 30 with respect to the housing 46. More specifically, the stop 58 is larger than the passageway 54 in the housing 46 through which the check link 30 extends, and therefore prevents movement of the end of the check link 30 through the housing 46 by physically interacting with the housing 46. The check link 30 defines a hole 60 at one end 62 through which a pin 64 is insertable to pivotably attach the bracket 34 to the end 62.

Referring again to FIG. 1, the door 18 includes a latch assembly 68 mounted to the inner panel 22 and positioned within the door cavity 42. A striker 72 is mounted to the vehicle body 10, as understood by those skilled in the art. The striker 72 is sufficiently positioned to extend through a hole in the inner panel 22 to engage the latch assembly 68 when the door 18 is in the closed position, so that the latch assembly 68 retains the striker 72 and, correspondingly, maintains the door 18 in the closed position.

Seals 76 are mounted to the body 10 and are positioned to contact the door 18 when the door 18 is in the closed position, as shown, to seal the door opening of the body 10. More specifically, the door 18 in the closed position elastically compresses the seals 76 so that the seals 76 store energy.

Figure 5:
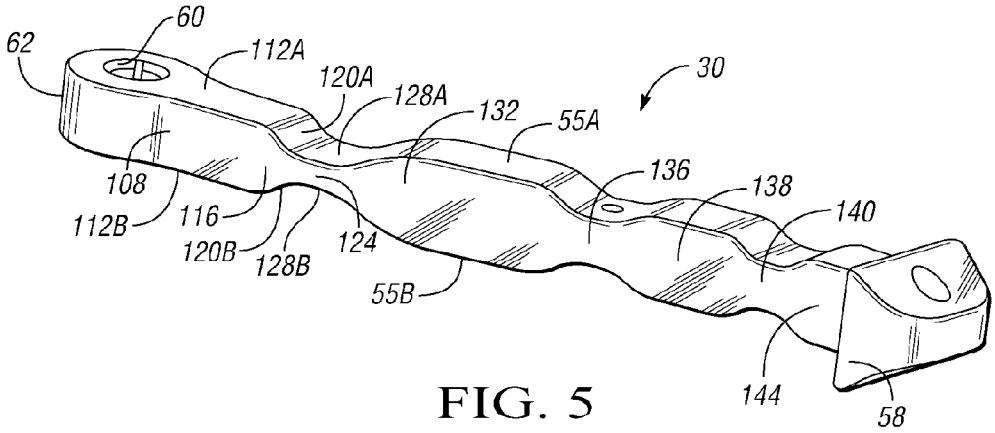
FIG. 5 is a schematic, perspective view of the check link of the check link assembly of FIG. 1.

Referring to FIG. 5, the check link 30 is characterized by a segment 108 adjacent end 62. Check link segment 108 includes segments 112A and 112B of surfaces 55A and 55B. Segment 108 of the check link 30 is sufficiently thick, i.e., surface segments 112A, 112B are sufficiently far apart from one another, that if bumpers 56A, 56B contact surface segments 112A, 112B, respectively, the springs 50A, 50B are compressed.

Check link segment 116 is adjacent to check link segment 108. Check link segment 116 is a ramp segment, i.e., the check link segment 116 becomes progressively thinner in the direction away from check link segment 108. Check link segment 116 includes segments 120A, 120B of surfaces 55A, 55B. Surface segments 120A, 120B are not parallel; rather, the distance therebetween decreases with distance from check link segment 108. Segment 124 of the check link 30, on the opposite side of the ramp segment 116 from segment 108, is characterized by parallel segments 128A, 128B of surfaces 55A, 55B.

Figure 6:
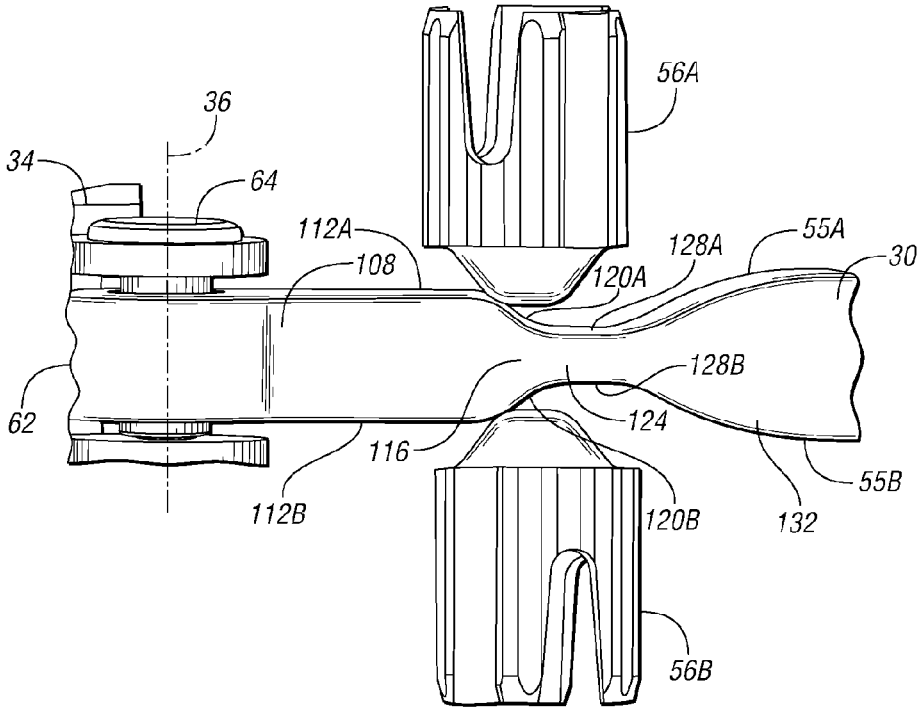
FIG. 6 is a schematic, side view of the check link and bumpers when the door is in the closed position.

Referring to FIGS. 1 and 6, when the door is in the closed position, bumpers 56A, 56B contact surfaces segments 120A, 120B of the ramp segment 116 so that the springs 50A, 50B are compressed. The latch assembly 68 is electrically actuated, i.e., the latch assembly 68 includes an electrically powered actuator, such as a servomotor or solenoid, that is operable to selectively disengage the striker 72 from the latch assembly 68. In one exemplary embodiment, the latch assembly 68 is operatively connected to a switch or other input device (not shown) mounted with respect to the vehicle body 10 that is operable to cause the disengagement of the striker 72 from the latch assembly 68. In another exemplary embodiment, the latch assembly 68 is responsive to radio frequency signals from a key fob transmitter (not shown) to disengage the striker 72 from the latch assembly 68. The electric actuation of the latch assembly 68 enables the door 18 to be characterized by the absence of an outside door handle.

When the latch assembly 68 releases the striker 72, the door 18 is free to rotate. The compressed springs 50A, 50B exert force on surface segments 120A, 120B via bumpers 56A, 56B. Surface segments 112A, 112B are substantially planar and horizontally oriented. Similarly, surface segments 128A, 128B are substantially planar and horizontally oriented. Surface segments 120A, 120B are inclined with respect to the horizontal orientation. Accordingly, when bumpers 56A, 56B exert forces on surface segments 120A, 120B, surface segments 120A, 120B exert reaction forces on the bumpers 56A, 56B that have a horizontal component. The horizontal component of the reaction forces urge the housing 46, and therefore the door 18, away from the hinge pillar 14. The horizontal component of the reaction forces move the bumpers 56A, 56B away from check link segment 108 until the bumpers 56A, 56B contact surface segments 128A, 128B, as shown in FIG. 7, and the door 18 is moved from the closed position to a partially open position, as shown in FIG. 8.

Figure 7:
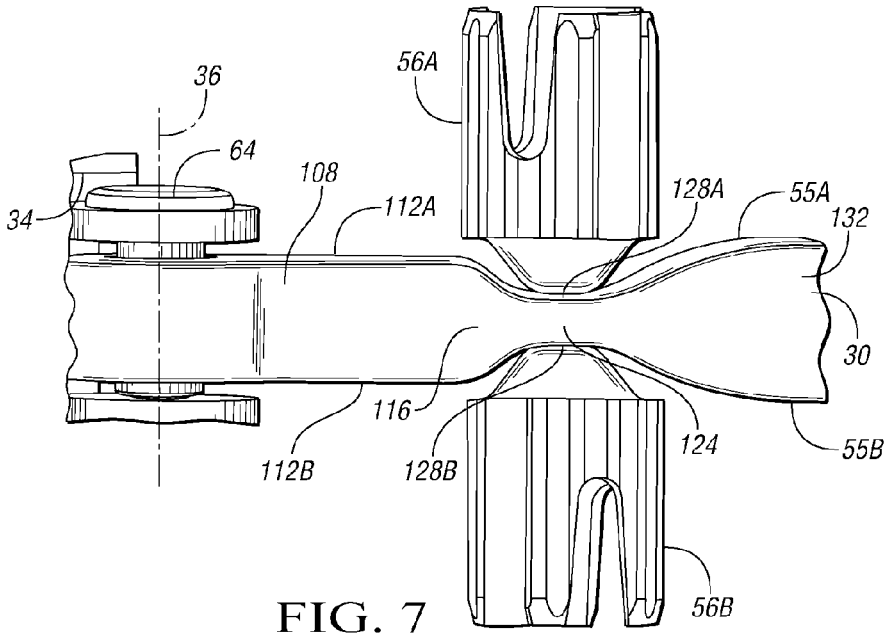
FIG. 7 is a schematic, side view of the check link and bumpers when the door is in a partially open position.
Figure 8:
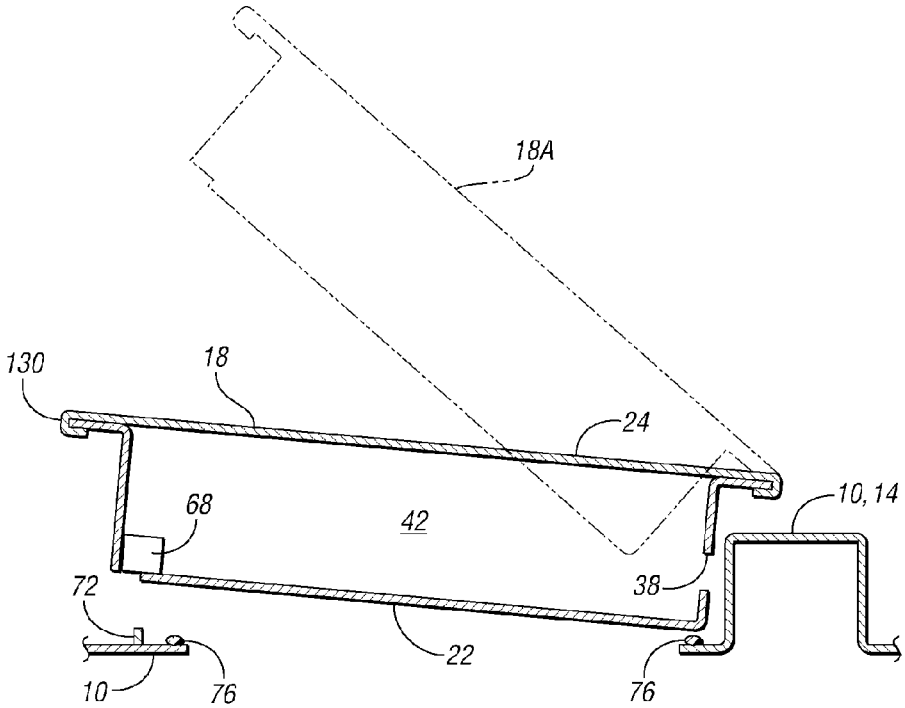
FIG. 8 is a schematic, cross-sectional, top view of the door and body of FIG. 1 with the door in the partially open position.

Referring to FIGS. 7 and 8, when the bumpers 56A, 56B are acting on surface segments 128A, 128B, the door 18 has rotated sufficiently such that a vehicle user can grasp the edge 130 of the door 18 to rotate the door further toward its fully open position (shown in phantom at 18A). Check link segment 132, on the opposite side of check link segment 124 from segment 116, is thicker than segment 124. Accordingly, as the door 18 is moved further toward the open position, the housing 46 moves such that check link segment 132 enters the passageway; since check link segment 132 is thicker than segment 124, the springs 50A, 50B are compressed, and resistance to rotation of the door 18 is provided.

Referring again to FIG. 5, check link segment 136 is between check link segments 132 and 138. Check link segment 136 is thinner than check link segments 132 and 138. Accordingly, when check link segment 136 is within the passageway 54, rotation of the door 18 in either direction results in compression of the springs 50A, 50B and a corresponding resistance to rotation. Thus, check link segment 136 provides an intermediate detent position for the door 18. Similarly, check link segment 140 is between check link segments 138 and 144. When the door is in the fully open position shown at 18A in FIG. 8, the housing 46 is positioned so that check link segment 140 is between the bumpers 56A, 56B. Check link segment 140 is thinner than segments 138, 144. Accordingly, when check link segment 140 is within the passageway 54, rotation of the door 18 in either direction results in compression of the springs 50A, 50B and a corresponding resistance to rotation. Thus, check link segment 140 provides a detent position for the door 18 when the door is in the fully open position.

It should be noted that, when the striker 72 is released from the latch assembly 68, the seals 76 exert a force on the door 18 urging it toward its open position as they release elastic strain. Seals 76 may thus act as springs.

As a vehicle user closes the door 18, the springs 50A, 50B are recompressed, storing energy to be employed in moving the door 18 toward the open position when the striker and latch are released.

Figure 9:
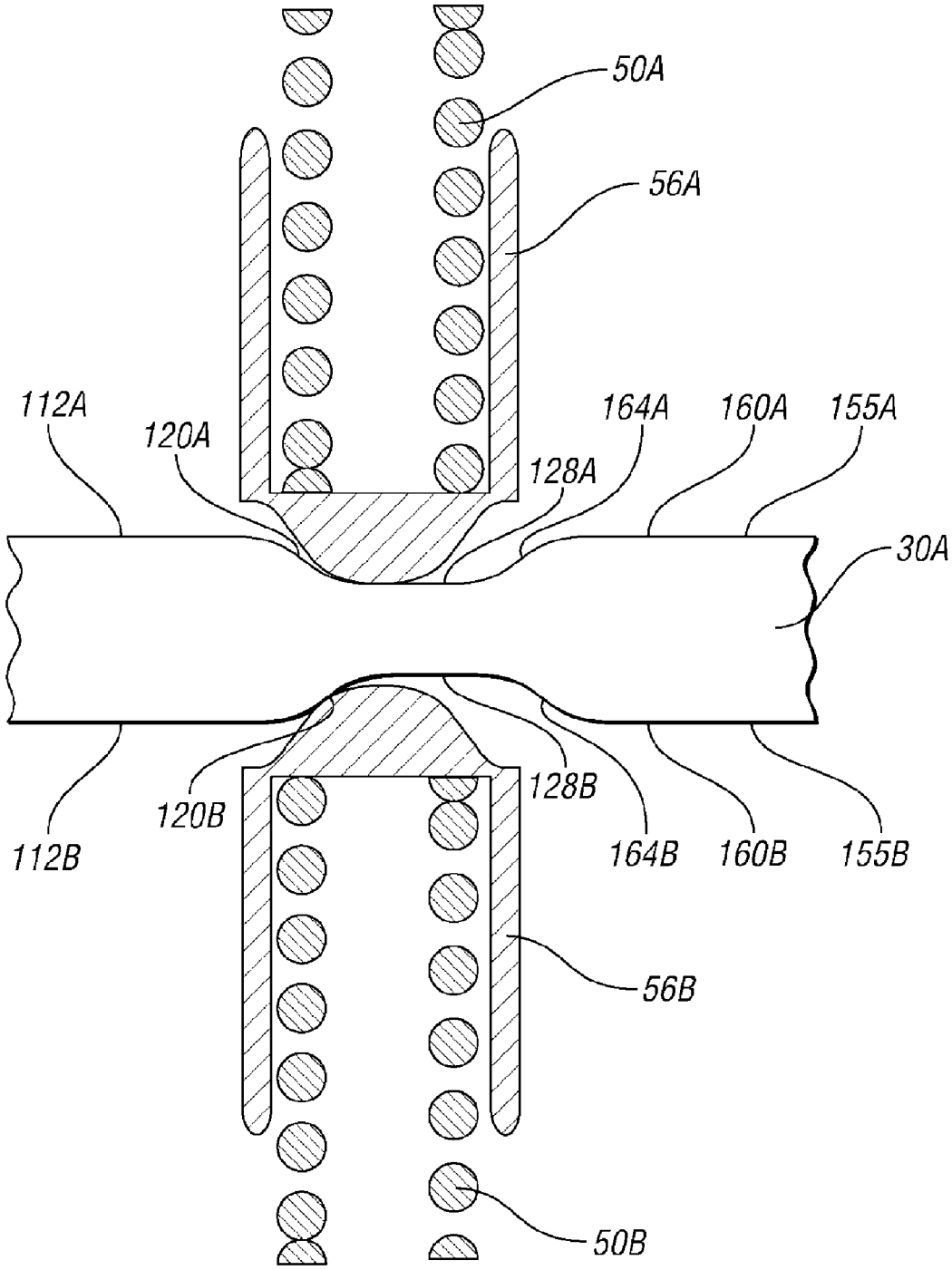
FIG. 9 is a schematic, cross-sectional side view of an alternative check link configuration.

Referring to FIG. 9, wherein like reference numbers refer to like components from FIGS. 1-8, an alternative check link configuration is schematically depicted. Check link 30A may be employed with the check link assembly shown at 26 in FIGS. 1-8. Check link 30A includes contoured surfaces 155A, 155B. Surface 155A is in contact with bumper 56A, and surface 155B is in contact with bumper 56B. Surface 155A is characterized by surface segments 112A, 120A, 128A. Surface 155B is characterized by surface segments 112B, 120B, 128B. Segments 112A, 112B, 128A, 128B are parallel to one another. Segment 120A interconnects segments 112A, 128A. Segment 120B interconnects segments 112B, 128B. Segments 120A, 120B are similarly sized and shaped, but the check link 30A is asymmetrical such that segments 120A, 120B are offset from one another.

More specifically, in the embodiment depicted, segment 112A is approximately 1.5 millimeters shorter than segment 112B, so that segment 120A is approximately 1.5 millimeters closer to the axis of rotation of the check link 30A than segment 120B. Correspondingly, segment 128A is approximately 1.5 millimeters closer to the axis of rotation than segment 128B.

The asymmetry of the surfaces 155A, 155B compensates for build tolerance in the distance between the hinge pillar (shown at 14 in FIG. 1) and the mounting position of the housing on the inner panel (shown at 46 and 22, respectively, in FIG. 1) by ensuring that at least one of the bumpers 56A, 56B is in contact with one of the ramp segments 120A, 120B when the door is in the closed position. For example, and with reference to FIG. 6, if build tolerance is such that bumpers 56A, 56B contact surface segments 112A, 112B, respectively, when the door is in the closed position, then the check link will not provide a reaction force sufficient to move the door toward the open position. Similarly, if build tolerance is such that bumpers 56A, 56B contact surface segments 128A, 128B, respectively, when the door is in the closed position, then the check link will not provide a reaction force sufficient to move the door toward the open position.

Referring again to FIG. 9, because of the offset of surfaces 120A, 120B, bumper 56A contacts surface segment 128A when bumper 56B contacts surface segment 120B. Accordingly, although surface segment 128A does not provide a reaction force to bumper 56A having a component sufficient to move the door toward the open position, bumper 56B is in contact with segment 120B, which, due to its incline, provides a reaction force to bumper 56B having a component effective to move the door toward its open position. Similarly, the offset is such that bumper 56A contacts surface segment 120A when bumper 56B contacts surface segment 112B, ensuring that at least one of the bumpers is in contact with a ramp segment 120A, 120B when the door is in the closed position.

When bumper 56A contacts surface segment 128A, and when bumper 56B contacts surface segment 128B, the door is in the partially open position shown at 18 in FIG. 8. Segments 160A, 160B of surfaces 155A, 155B, respectively, are parellel to surface segments 112A, 112B, 128A, 128B. The thickness of the check link 30A between surface segments 160A, 160B is greater than the thickness between surface segments 128A, 128B. Surface segment 164A is a ramp that interconnects surface segment 128A and surface segment 160A. Surface segment 164B is a ramp that interconnects surface segment 128B and surface segment 160B.

Referring to FIGS. 8 and 9, as the door 18 is rotated from the partially open position toward the fully open position shown at 18A, the bumpers 56A, 56B contact surface segments 164A, 164B, respectively. As the bumpers 56A, 56B traverse surface segments 164A, 164B, the bumpers 56A, 56B compress springs 50A, 50B, thereby causing increased resistance to the rotation of the door.

In the embodiment depicted, the placement and shape of surface segments 164A, 164B are sufficient to prevent the door 18 from opening beyond the partially open position unless at least a predetermined amount of force is applied to the door. For example, if the vehicle body is on an incline, gravity may exert a force on the door that urges the door toward the fully open position. Accordingly, the predetermined amount of force may be higher than the gravitional force that urges the door toward the fully open position when the body is on an inclined plane of less than a predetermined angle.

While the best modes for carrying out the invention have been described in detail, those familiar with the art to which this invention relates will recognize various alternative designs and embodiments for practicing the invention within the scope of the appended claims.

The invention claimed is:

1. A check link assembly for a door rotatably mounted to a vehicle body for movement between a closed position and an open position, the check link assembly comprising:

a link having a first contoured surface and a second contoured surface on an opposite side of the link from the first contoured surface;

a first member contacting the first contoured surface;

a second member contacting the second contoured surface;

at least one spring biasing the first member into contact with the first contoured surface and biasing the second member into contact with the second contoured surface;

wherein the first and second contoured surfaces include respective first, second, and third segments; wherein the first segment of the first contoured surface and the first segment of the second contoured surface are parallel to one another;

wherein the third segment of the first contoured surface and the third segment of the second contoured surface are parallel to one another;

wherein the thickness of the link between the first segments is greater than the thickness of the link between the third segments;

wherein the second segment of the first contoured surface interconnects the first and third segments of the first contoured surface;

wherein the second segment of the second contoured surface interconnects the first and third segments of the second contoured surface; and wherein the check link assembly is configured such that one of said first and second members contacts one of said second segments when the other of said first and second members contacts one of said first and third segments.

2. The check link assembly of claim 1, further comprising a housing containing said at least one spring and said first and second members, and defining a passageway through which the link is selectively movable.

3. The check link assembly of claim 2, wherein said at least one spring includes a first spring biasing the first member into contact with the first contoured surface and a second spring biasing the second member into contact with the second contoured surface.

4. The check link assembly of claim 2, wherein the check link assembly is configured such that, when the link is operatively connected to one of the body and the door and the housing is operatively connected to the other of the body and the door, and the door is in the closed position, one of said first and second members contacts one of said second segments and the other of said first and second members contacts one of said first and third segments.

* * * * *